US006000307A

United States Patent [19]

Aamodt

[11] Patent Number: 6,000,307

[45] Date of Patent: Dec. 14, 1999

[54] UTILITY CUTTING TOOL AND METHOD

[76] Inventor: Robert Wayne Aamodt, 3170 Arena Rd., Colorado Springs, Colo. 80921

[21] Appl. No.: 09/019,411

[22] Filed: Feb. 5, 1998

[51] Int. Cl.[6] ..... B26B 13/12

[52] U.S. Cl. ..... 83/13; 30/190; 30/251; 83/694

[58] Field of Search ..... 83/13, 694; 30/186, 30/190, 193, 251

[56] References Cited

U.S. PATENT DOCUMENTS

| | | | |
|---|---|---|---|
| 5,003,695 | 4/1991 | Lipscomb et al. | 30/193 |
| 5,272,810 | 12/1993 | Orthey | 30/186 |
| 5,469,625 | 11/1995 | Melter et al. | 30/251 |
| 5,511,314 | 4/1996 | Huang | 30/251 |
| 5,566,453 | 10/1996 | Lin | 309/190 |

OTHER PUBLICATIONS

Craftsman Tools "Handi–Cut" packaging.

*Primary Examiner*—M. Rachuba
*Assistant Examiner*—Sean Pryor
*Attorney, Agent, or Firm*—Linda Flewellen Gould

[57] ABSTRACT

A method of cutting is described, utilizing a specialized utility cutting tool. The tool has a fixed jaw, a movable handle, a blade, and a connecting link. The blade is inserted into a channel formed in the fixed jaw for stability, and is pivotally connected to that fixed jaw. The blade is connected to the connecting link which is connected at an opposite end to the movable handle, so that moving the movable handle toward a handle of the fixed jaw moves the blade. The connecting link provides a mechanical advantage to apply more force to an item to be cut than would be possible without the connecting link. An anvil is mounted in a channel formed in a substantially straight edge of the fixed jaw, and the sharp edge of the blade is moved toward that anvil as the handles of the fixed and movable handles are squeezed together.

16 Claims, 3 Drawing Sheets

UTILITY CUTTING TOOL AND METHOD

BACKGROUND OF THE INVENTION

1. Technical Field

This invention pertains to a method and tool for cutting, suitable for cutting such diverse materials as tree branches, carpet and flooring materials, wire, construction materials, automotive moldings and trim, wood trim, rope, vinyl, hose, rubber, plastic, thick paper, and leather.

2. Background Art

A number of different utility tools are commercially available for a variety of cutting jobs. Some commonly used cutting tools rely on coordinating blades which are moved adjacent to each other to cut materials placed between the blades. Examples of shears using this method of cutting are found in U.S. Pat. No. 5,469,625 to Melter et al. and U.S. Pat. No. 5,511,314 to Huang. Huang utilizes the dual blades by leaving one blade in an indentation of the material being cut created by a first effort of cutting, as the coordinating blade is released and then closed again to effectively whittle away a branch or other material to be cut. Both Huang and Melter teach the use of a connecting link to achieve a mechanical advantage as the handles of the shears are forced together, increasing the force applied to the cutting blades as they are closed around the material to be cut. While this mechanical advantage allows branches and other materials to be efficiently cut, the life of such tools is limited. With use, the blades are eventually bent away from each other as the force of cutting pushes the blades outward from each other, wearing on the fulcrum or pivot points by which the jaws of the shears are connected to each other.

Similarly, U.S. Pat. No. 5,566,453 to Lin describes a pair of gardening shears that include a connecting link to provide a mechanical advantage for increasing the force applied to a workpiece being cut. Lin does not use opposing and adjacent blades, but rather drives a blade into a serrated curved fang. As with the previously mentioned shears, use of the Lin shears will eventually strain the pivot points at which the adjacent handles are attached to each other, possibly resulting in misalignment of the shears.

Other common cutting tools utilize a single blade which closes onto an anvil, cutting materials placed between the open blade and the anvil as the blade closes. Examples are found in U.S. Pat. Nos. 5,272,810 to Orthey and 5,003,695 to Lipscomb et al. Orthey discloses garden shears having an anvil and opposing blade connected to handles which are connected at a pivot point. Addressing the problem that use of the shears eventually results in misalignment of the blade and anvil, Orthey provides a mechanism for adjusting the anvil with respect to the blade, to correct such misalignment and extend the useful life of the tool. Lipscomb teaches snips with a rotatable anvil and two handles attached side-by-side at a pivot point.

A blade and anvil cutting tool is sold by Craftsman tools under the tradename "Handi-Cut". The Craftsman product is labeled to provide notice that a patent application is pending. The Craftsman tool has two jaws, with a reduced diameter segment of one jaw fitting within a channel of the other jaw. In this manner, the jaw supporting the blade can be moved around a pivot point, as that blade jaw is moved toward the anvil supported by the other jaw. The Craftsman product does not enjoy the mechanical advantage of a connecting link to leverage force applied to one handle, and the channel through which the reduced diameter segment fits is not suitable for receiving such a mechanism.

While each of these cutting tools is useful for its intended purpose, none provides a significant mechanical advantage to leverage the force applied on tool handles while also avoiding the misalignment and decreased efficiency caused by long-term stress to fulcrum points which hold together adjacent jaws.

DISCLOSURE OF THE INVENTION

Summary of the Invention

An object of this invention is to provide a new and useful method for cutting a variety of materials, providing a mechanical advantage to leverage force applied on tool handles and thus increase cutting efficiency of a blade being forced against an anvil.

Another object of this invention is to provide a new and useful tool for cutting which does not loose its effectiveness due to stress on fulcrum points where adjacent jaws of the tool are connected.

Yet another object of this invention is to provide such a utility cutting tool which has a specialized anvil suitable for supporting hard materials while providing a surface which is sufficiently malleable to avoid unnecessary dulling of the blade.

The utility cutting tool claimed herein consists of a fixed jaw, a movable handle, a blade, and a connecting link. The movable handle is pivotally connected to the fixed jaw. The fixed jaw is advantageously shaped so that a lower segment of the fixed jaw, which functions as the fixed jaw handle, is substantially parallel to and spaced apart from the movable handle when the movable handle is pulled toward the fixed jaw handle. A middle segment of the fixed jaw curves toward the movable handle and an upper segment of the fixed jaw extends away from the movable handle along a line extending forward from the movable handle. The lower segment of the fixed jaw and the movable handle are aligned so that they may be conveniently grasped and moved toward one another with a single hand. In a preferred embodiment, the fixed jaw handle and the movable handle form opposing concave arches, to facilitate grasping and clasping the two jaws.

The middle segment of the fixed jaw has a middle segment channel through which the blade is inserted. One end of the blade is pivotally connected to one end of the connecting link, while the other end, which has a sharp edge, is adjacent to the upper segment of the fixed jaw. The other end of the connecting link is pivotally connected to the movable handle. In this manner, the movable handle and fixed jaw handle can be clasped in one hand and squeezed together, resulting in the blade being moved toward the upper segment of the fixed jaw.

Because the blade is inserted into the middle segment channel, and is also inserted into a connecting link channel in the connecting link, side-to-side movement of the blade is not permitted. By impeding side-to-side movement of the blade, the utility cutting tool minimizes stress on the various pivot points and connecting points, while assuring a straight cut of an item placed between the blade and the upper segment of the fixed jaw. The middle segment channel extends to fully encase the upper non-cutting portion of the blade as the fixed jaw handle and movable handle are moved together, restricting blade movement and assuring that the blade does not wander as it cuts through a workpiece. Heavier materials can be cut without "gnawing" those materials as frequently occurs with tools known in the prior art.

Use of the connecting link provides a mechanical advantage to increase the force being applied to the blade as it is moved through an item to be cut. If the movable handle was connected directly to the blade, a one-to-one ratio would be achieved; use of the connecting link provides a two-to-one ratio. For each measured unit the movable handle is moved toward the fixed jaw, the blade is moved only half that distance, allowing more force to be applied to the item to be cut.

In a preferred embodiment, an anvil channel is carved out of a substantially straight edge of the upper segment of the fixed jaw. This anvil channel is surrounded by the right side and left side of the fixed jaw. Since the fixed jaw is advantageously constructed of metal or other hard material, an item to be cut is well supported by the substantially straight edges on either side of the anvil channel. An anvil, preferably made of a malleable material such as plastic, can be inserted in the anvil channel. As the tool is used, the blade is pulled into contact with the anvil with each cut. By making the anvil from a relatively malleable substance, wear on the blade is reduced. Furthermore, when the anvil is worn, it can easily be replaced.

The novel features that are considered characteristic of the invention are set forth with particularity in the claims. The invention itself, both as to its construction and its method of operation, together with additional objects and advantages thereof, will best be understood from the description of specific embodiments which follows, when read in conjunction with the accompanying drawings.

DETAILED DESCRIPTION OF THE PREFERRED EMBODIMENT

The present invention concerns a new and improved method of cutting a variety of materials, including plants and tree branches, carpet and flooring materials, cable and wire, construction materials, rubber, plastic, thick paper, and leather, using a specialized tool described herein.

In the following description, numerous specific details are set forth in order to provide a thorough understanding of the present invention. It will be obvious, however, to one skilled in the art that the present invention may be practiced without these specific details. Some well-known methods and structure have not been set forth in order not to unnecessarily obscure the description of the present invention.

Figure 2:
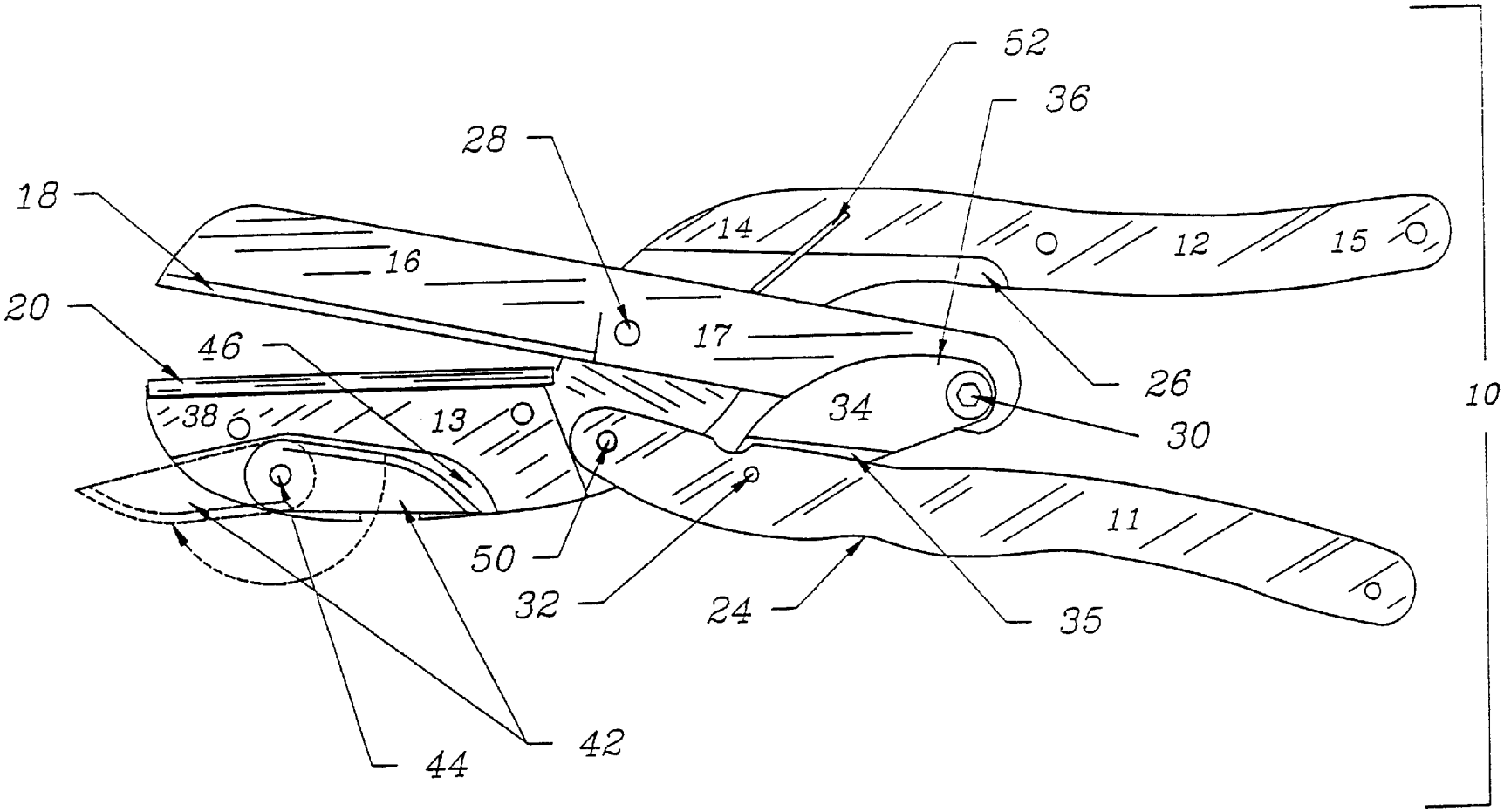
FIG. 2 is a cut-away side view of the embodiment of the present invention shown in FIG. 1.

The utility cutting tool 10 of the present invention can be better understood by reference to FIG. 2. The novel tool 10 consists of a fixed jaw 12, a movable handle 11, a blade 16, and a connecting link 34. The fixed jaw 12 ideally consists of two essentially linear sections, an upper segment 13 and a lower segment 15, connected by a middle segment 14 which curves between linear segments 13, 15. Movable handle 11 is pivotally connected to middle segment 14 by a pin 50 which permits movable handle 11 to rotate within a limited area around the pin 50. Movable handle 11 can extend substantially parallel to lower segment 15, allowing movable handle 11 and lower segment 15 to be grasped and pulled together by a single hand (not shown).

Figure 1:
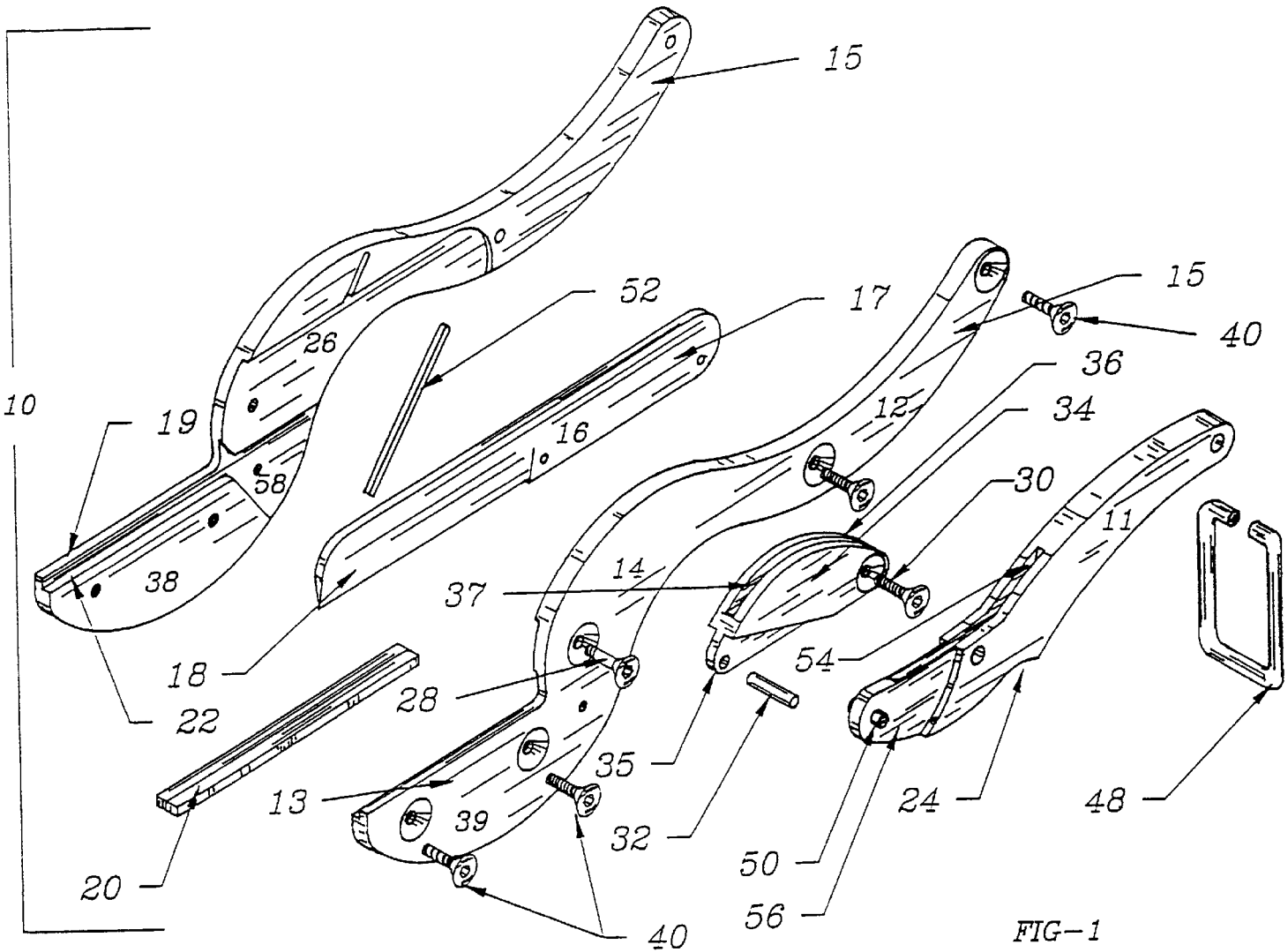
FIG. 1 is a perspective exploded view of a utility cutting tool, according to the present invention.

As shown in FIG. 1, blade 16 consists of an upper portion 18 which has a sharp edge, and an insertable portion 17. The insertable portion 17 of the blade 16 is inserted into a middle segment channel 26 in the fixed jaw 12, inhibiting side-to-side movement even when significant pressure is applied to the blade to cut through hard-to-cut materials.

Figure 3:
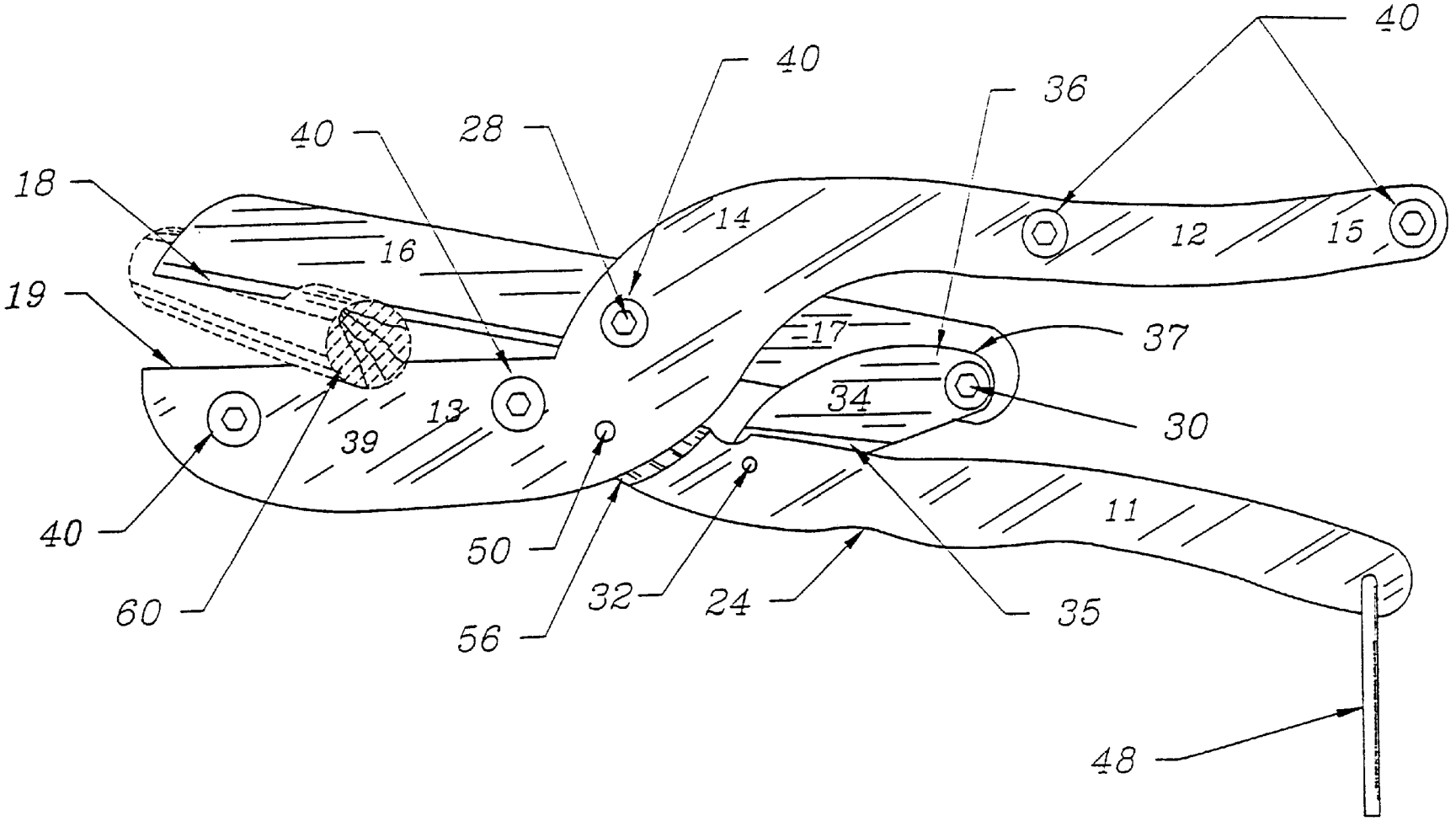
FIG. 3 is a perspective view of a utility cutting tool being used to cut an article, according to the present invention.

A connecting link 34 connects the movable handle 11 to the blade 16. As best shown in FIG. 3, the movable handle end 35 of the connecting link 34 is pivotally connected to the movable handle 11 by pivot pin 32. Similarly, the blade end 36 of connecting link 34 is pivotally connected to the blade 16 by pivot pin 30. A connecting link channel 37 formed in the blade end 36 is suitable for receiving the blade 16 so that a portion of the blade 16 rotates within the connecting link channel 37. At the other end 35 of the connecting link 34, the connecting link 34 is inserted into a movable handle channel 54 in the movable handle 11, as shown in FIG. 1. By inserting an end of each component into a channel formed in an adjacent and connected component, side-to-side movement and twisting of the component is inhibited. Because side-to-side movement of each component is impeded by insertion into channels, the components do not have wear caused by twisting the components relative to each other, thus resulting in a relatively strong and durable tool. The channels provide stability for the blade 16 so that the blade 16 is not bent by pressure from cutting.

In order to maintain a uniform thickness of each component of the tool, while providing the durability and stability afforded by inserting ends of each component into channels formed in adjacent components, it is advantageous to provide reduced width segments of various components to permit those reduced width segments to be inserted into the appropriate channels. For example, as shown in FIG. 1, movable handle end 35 of connecting link 34 has a width less than the width of the remainder of the connecting link 34 to facilitate movement of the connecting link 34 within the movable handle channel 54. Similarly, the end 56 of the movable handle 11 which connects to the fixed jaw 12 advantageously has a reduced width which will fit into the fixed jaw channel 58.

The fixed jaw 12 is conveniently made of two mirror image pieces: a right side 38 and left side 39. These pieces 38,39 can be held together by screws, pins, nails, or dowels 40, which are located at various points in the segments 13,14,15, as shown in FIG. 3. For ease in manufacturing the tool 10, each piece 38,39 is fashioned with a carved out portion which forms the middle segment channel 26 when the right side 38 and left side 39 are fit together, suitable for receiving the inserted blade 16, as best shown in FIG. 1.

The blade 16 is held in place within the middle segment channel 26 by a screw, pin, or dowel 28 which is inserted through the middle segment 14, through the middle segment channel 26, and through the blade 16 itself, providing a fulcrum around which the blade 16 can rotate within a limited range. The limited area in which the blade 16 can rotate is defined by two extreme positions. At one end of the limited area, the blade 16 rests against the straight edge 19 of the upper segment 13 when the movable handle 11 is pulled toward the fixed jaw 12. The other end of the limited area is the position to which the blade 16 moves when the movable handle 11 is extended as completely as possible from the fixed jaw 12, which is a function of the length of the connecting link 34.

A fixed jaw channel 58 can be conveniently formed by creating mirror image carved out portions in the right side 38 and left side 39, for receiving the jaw pivot end 56 of the movable handle 11. Alternatively, the fixed jaw channel 58 and middle segment channel 26 may comprise a continuous single channel, as shown in FIG. 2.

Another carved out portion of the right side 38 and left side 39 creates an anvil channel 22 between the right side 38 and left side 39 along the straight edge 19 of the upper segment 13. This straight edge 19 is designed to support an item 60 to be cut, as best shown in FIG. 3. Because the fixed jaw 12 is advantageously made of metal or other rigid material, the straight edge 19 provides a strong support for a variety of items 60 to be cut.

A removable anvil 20 may be conveniently inserted into the anvil channel 22. This anvil has a straight surface which continuously forms the straight edge 19 along with the right side 38 and left side 39 of the upper segment 13. Thus, when the movable handle 11 is pulled toward the handle 15 of the fixed jaw 12, pushing the blade 16 toward the straight edge 19, the blade 16 cuts through an item 60 placed between the straight edge 19 and the blade 16, with the blade 16 eventually contacting the anvil 20. The anvil 20 can be made of plastic or other malleable material, which does not tend to dull the blade 16 as much as contact with a rigid material would do.

The anvil 20 may be easily removed by loosening screws or pins 40 to separate the right side 38 from the left side 39. Thus, the anvil 20 may be cleaned, inverted to utilize another side of the anvil, or replaced. When taken apart, the entire tool can be placed in a common dishwasher for cleaning, and then easily reassembled.

A spring mechanism 52 may be placed in the middle segment channel 26 to provide pressure to push the movable handle 11 away from the lower segment 15 of the fixed jaw 12. In this manner, the movable handle 11 tends to a position from which a single hand can push the movable handle 11 toward the fixed jaw 12. Because of the mechanical advantage created by the connecting link 34, pressure applied to push the movable handle 11 toward the fixed jaw 12 is multiplied and applied to the blade 16 as it is driven toward the straight edge 19.

It has been found that the movable handle 11 and fixed jaw handle 15 can be most easily grasped when these components are shaped as opposing concave arches, as shown in FIG. 3. A finger ridge 24 provides a convenient resting place for an index finger of the hand used to grasp the tool, providing stability as an item 60 is cut. A U-shaped wire 48 may conveniently be attached to one end of the movable handle 11 or fixed jaw handle 15, suitable for being looped over the other handle to hold the blade 16 in a closed position next to the straight edge 19 when the tool 10 is not in use, as shown in FIG. 3.

In one embodiment, an auxiliary blade 42 is provided for cutting materials which are not suitable for placing between an anvil and blade, such as flooring materials that are already secured to a floor. This auxiliary blade 42 can be stored within an opening 46 in the upper segment 13, but is rotatable out of the opening 46 around a pivot pin 44 when it is to be used.

Another embodiment permits a large branch or pipe to be held in place between the anvil 20 and the blade 16, to prevent the large object 60 from being pushed out of the grasp of the tool 10 as the blade 16 is moved toward the anvil 20. This is accomplished by forming a U-shaped groove (not shown) in the edge 19 of the upper segment 13 of the fixed jaw 12, so that the object to be cut 60 can be held in place within that U-shaped groove.

The tool 10 can be adapted for use as a wire crimper or stripper. For example, one or more grooves (not shown) can be advantageously formed in the blade 16 while the anvil 20 may be crimped. By moving the handles 11, 15 together, a wire 60 held in the crimped anvil 20 can be stripped or a low voltage terminal can be crimped onto that wire.

The invention has been described in detail with particular reference to preferred embodiments thereof. As will be apparent to those skilled in the art in the light of the accompanying disclosure, many alterations, substitutions, modifications, and variations are possible in the practice of the invention without departing from the spirit and scope of the invention.

I claim:

1. A method of cutting, comprising the steps of:

a. grasping a tool having:

i. a fixed jaw having a handle segment thereof suitable for being grasped, an upper segment with a substantially straight edge, a middle segment connecting said handle segment to said upper segment, a left side, a right side, and a middle segment channel formed between said left side and said right side of said middle segment, integral to said upper segment and said handle segment, ii. a movable handle pivotally fastened to said fixed jaw, suitable for being grasped and pulled toward said handle segment of said fixed jaw, iii. a blade pivotally fastened to said middle segment of said fixed jaw, an insertable portion of which blade is movable within said middle segment channel, and an upper portion of which blade has a sharp edge, and iv. a connecting link pivotally connected to said movable handle on a movable handle end and pivotally connected to said blade on an opposite blade end, so that pulling said movable handle toward said fixed jaw moves said sharp edge of said blade toward said substantially straight edge of said fixed jaw, b. placing an item to be cut between said blade and said substantially straight edge, and c. moving said movable handle toward said fixed jaw, thus moving said blade to contact said substantially straight edge through said item to be cut.

2. A utility cutting tool, comprising:

a. a fixed jaw having a handle segment thereof suitable for being grasped, an upper segment with a substantially straight edge, a middle segment connecting said handle segment to said upper segment, a left side, a right side, and a middle segment channel formed between said left side and said right side of said middle segment, integral to said upper segment and said handle segment, b. a movable handle pivotally fastened to said fixed jaw, suitable for being grasped and pulled toward said handle segment of said fixed jaw, c. a blade pivotally fastened to said middle segment of said fixed jaw, an insertable portion of which blade is movable within said middle segment channel, and an upper portion of which blade has a sharp edge, d. a connecting link pivotally connected to said movable handle on a movable handle end and pivotally connected to said blade on an opposite blade end, so that pulling said movable handle toward said fixed jaw moves said sharp edge of said blade toward said substantially straight edge of said fixed jaw.

3. A utility cutting tool as described in claim 2, wherein said movable handle and said handle segment of said fixed jaw form opposing concave arches.

4. A utility cutting tool as described in claim 3, further comprising a depression formed in said movable handle suitable for receiving a finger of a hand grasping said tool.

5. A utility cutting tool as described in claim 2, wherein said movable handle end of said connecting link inserts into a movable handle channel formed in said movable handle.

6. A utility cutting tool as described in claim 2, wherein a jaw pivot end of said movable handle connected to said fixed jaw inserts into a fixed jaw channel formed between said right side and said left side of said fixed jaw.

7. A utility cutting tool as described in claim 6, wherein said handle segment of said fixed jaw and said movable handle each have a width suitable for manual grasping, and said jaw pivot end of said movable handle has a reduced width suitable for inserting into said fixed jaw channel.

8. A utility cutting tool as described in claim 2, wherein said blade inserts into a connecting link channel formed in said blade end of said connecting link.

9. A utility cutting tool as described in claim 2, further comprising a spring means for pushing said blade away from said substantially straight edge of said fixed jaw.

10. A utility cutting tool as described in claim 9, wherein said spring means further comprises a spring mounted in said middle segment channel.

11. A utility cutting tool as described in claim 2, wherein:

a. an anvil channel is formed between said right side and said left side of said upper segment of said fixed jaw, said anvil channel being between said substantially straight edge of said right side and said substantially straight edge of said left side, and b. an anvil is inserted in said anvil channel.

12. A utility cutting tool as described in claim 11, wherein said anvil has a crimped face and said blade has at least one groove formed therein.

13. A utility cutting tool as described in claim 11, wherein said right side and said left side of said fixed jaw are held together by a plurality of screws, such that tightening said screws holds said anvil in said anvil channel.

14. A utility cutting tool comprising:

a. a fixed jaw having a handle segment thereof suitable for being grasped, an upper segment with a substantially straight edge, a middle segment connecting said lower segment to said upper segment, a left side, and a right side, b. a movable handle pivotally fastened to said fixed jaw, suitable for being grasped and pulled toward said lower segment of said fixed jaw, c. a blade pivotally fastened to said middle segment of said fixed jaw, an insertable portion of which blade is movable within a middle segment channel formed between said left side and said right side of said middle segment of said fixed jaw, and an upper portion of which blade has a sharp edge, d. a connecting link pivotally connected to said movable handle on a movable handle end and pivotally connected to said blade on an opposite blade end, so that pulling said movable handle toward said fixed jaw moves said sharp edge of said blade toward said substantially straight edge of said fixed jaw, and e. an auxiliary blade insertable into an auxiliary blade channel formed in said upper segment of said fixed jaw.

15. A utility cutting tool, comprising:

a. a fixed jaw having a handle segment thereof suitable for being grasped, an upper segment with a substantially straight edge in which at least one substantially U-shaped groove has been formed, a middle segment connecting said handle segment to said upper segment, a left side, a right side, and a middle segment channel formed between said left side and said right side of said middle segment, integral to said upper segment and said handle segment, b. a movable handle pivotally fastened to said fixed jaw, suitable for being grasped and pulled toward said handle segment of said fixed jaw, c. a blade pivotally fastened to said middle segment of said fixed jaw, an insertable portion of which blade is movable within said middle segment channel, and an upper portion of which blade has a sharp edge, d. a connecting link pivotally connected to said movable handle on a movable handle end and pivotally connected to said blade on an opposite blade end, so that pulling said movable handle toward said fixed jaw moves said sharp edge of said blade toward said substantially straight edge of said fixed jaw.

16. A utility cutting tool, comprising:

a. a fixed jaw having a handle segment thereof suitable for being grasped, an upper segment with a substantially straight edge, a middle segment connecting said handle segment to said upper segment, a left side, a right side, and a middle segment channel formed between said left side and said right side of said middle segment, b. a movable handle pivotally fastened to said fixed jaw, suitable for being grasped and pulled toward said handle segment of said fixed jaw, c. a blade pivotally fastened to said middle segment of said fixed jaw, an insertable portion of which blade is movable within said middle segment channel, and an upper portion of which blade has a sharp edge, d. a connecting link pivotally connected to said movable handle on a movable handle end and pivotally connected to said blade on an opposite blade end, so that pulling said movable handle toward said fixed jaw moves said sharp edge of said blade toward said substantially straight edge of said fixed jaw, and pressure applied to said movable handle is multiplied and applied to said blade.

* * * * *